US009651965B2

(12) United States Patent
Cui et al.

(10) Patent No.: US 9,651,965 B2
(45) Date of Patent: May 16, 2017

(54) LOW QUIESCENT CURRENT LINEAR REGULATOR CIRCUIT

(71) Applicant: STMicroelectronics (China) Investment Co. Ltd, Shanghai (CN)

(72) Inventors: Zhenghao Cui, Beijing (CN); Ming Jiang, Shanghai (CN)

(73) Assignee: STMICROELECTRONICS (CHINA) INVESTMENT CO. LTD, Shanghai (CN)

( * ) Notice: Subject to any disclaimer, the term of this patent is extended or adjusted under 35 U.S.C. 154(b) by 0 days.

(21) Appl. No.: 14/880,614

(22) Filed: Oct. 12, 2015

(65) Prior Publication Data

US 2017/0090493 A1 Mar. 30, 2017

(30) Foreign Application Priority Data

Sep. 29, 2015 (CN) ..... 2015 1 0631259

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/565; G05F 1/575
See application file for complete search history.

(56) References Cited

U.S. PATENT DOCUMENTS 5,325,258 A * 6/1994 Choi ..... H03K 17/0828 323/276
6,600,299 B2 * 7/2003 Xi ..... G05F 1/575 323/280
2012/0242307 A1 * 9/2012 Higuchi ..... H02M 3/156 323/273

* cited by examiner

*Primary Examiner* — Gary L Laxton
(74) *Attorney, Agent, or Firm* — Gardere Wynne Sewell LLP

(57) ABSTRACT

A linear regulator circuit includes a power transistor coupled between an input voltage node and an output voltage node. A control circuit of the linear regulator includes a feedback network having an input coupled to the output voltage node and an output configured to generate a feedback voltage. An error amplifier receives a reference voltage and the feedback voltage to generate an error signal. A driver circuit receives the error signal and has an output coupled to drive a control terminal of the power transistor. A first power supply terminal of the driver circuit is coupled to a first power supply node and a second power supply terminal of the driver circuit is coupled to the output voltage node. The bias current for operation of the driver circuit is accordingly directly sourced to the output voltage node to support low quiescent current operation of the regulator circuit.

15 Claims, 2 Drawing Sheets

LOW QUIESCENT CURRENT LINEAR REGULATOR CIRCUIT

PRIORITY CLAIM

This application claims priority from Chinese Application for Patent No. 201510631259.0 filed Sep. 29, 2015, the disclosure of which is incorporated by reference.

TECHNICAL FIELD

The present invention relates to linear regulator circuits and, in particular, to a linear regulator circuit with a low quiescent current consumption characteristic.

BACKGROUND

There is a need in the art for an improved linear regulator circuit that can save the current of driver circuit while maintaining loading capability. It would be preferred for the linear regulator circuit to operate, no matter how much output current is needed, with a reduced current consumption.

SUMMARY

In an embodiment, a linear regulator control circuit configured to control a power transistor coupled between an input voltage node and an output voltage node comprises: a feedback network having an input coupled to the output voltage node and an output configured to generate a feedback voltage; an error amplifier having a first input configured to receive a reference voltage and a second input configured to receive the feedback voltage; and a driver circuit having an input coupled to an output of the error amplifier and an output coupled to drive a control terminal of the power transistor, the driver circuit having a first power supply terminal coupled to a first power supply node and a second power supply terminal coupled to the output voltage node.

In an embodiment, a linear regulator control circuit configured to control a power transistor coupled between an input voltage node and an output voltage node comprises: a feedback network having an input coupled to the output voltage node and an output configured to generate a feedback voltage; an error amplifier having a first input configured to receive a reference voltage and a second input configured to receive the feedback voltage; and a driver circuit having an input coupled to an output of the error amplifier and an output coupled to drive a control terminal of the power transistor, the driver circuit including an amplifier circuit coupled between a first power supply terminal and a second power supply terminal; wherein said second power supply terminal of the driver circuit is directly connected to the output voltage node.

In an embodiment, a linear regulator control circuit configured to control a power transistor coupled between an input voltage node and an output voltage node comprises: a feedback network coupled between the output voltage node and a ground power supply node, and having an output configured to generate a feedback voltage; an error amplifier having a first input configured to receive a reference voltage and a second input configured to receive the feedback voltage, said error amplifier having a first power supply terminal directly connected to a positive power supply node and a second power supply terminal directly connected to the ground power supply node; and a driver circuit having an input coupled to an output of the error amplifier and an output coupled to drive a control terminal of the power transistor, the driver circuit having a first power supply terminal directly connected to the positive power supply node and a second power supply terminal directly connected to the output voltage node.

BRIEF DESCRIPTION OF THE DRAWINGS

For a better understanding of the embodiments, reference will now be made by way of example only to the accompanying figures in which.

DETAILED DESCRIPTION OF THE DRAWINGS

Figure 1:
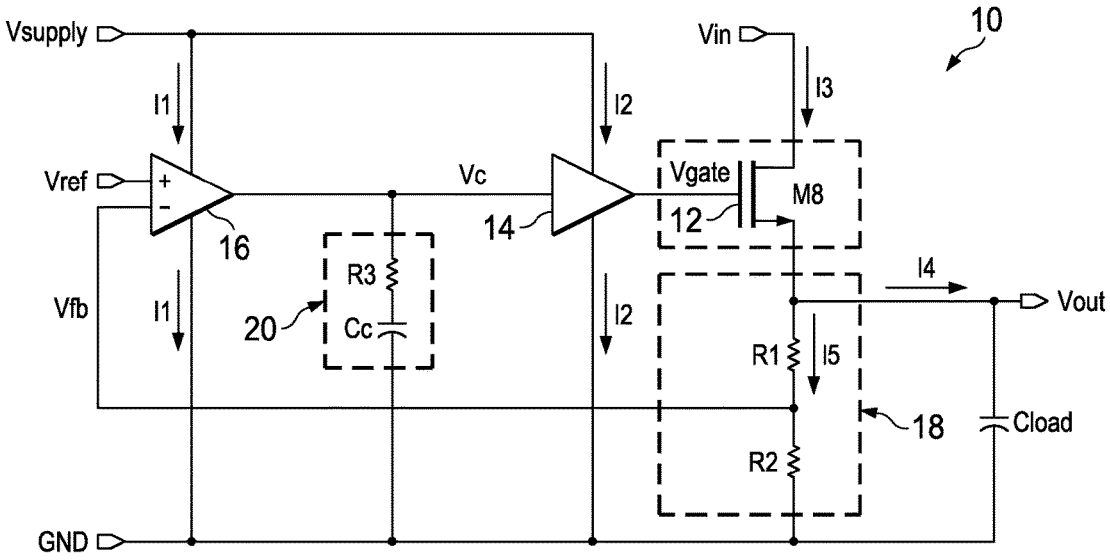
FIG. 1 (PRIOR ART)
FIG. 1 is a circuit diagram for an embodiment of a linear regulator circuit.

Reference is made to FIG. 1 showing a linear regulator circuit 10. The circuit 10 includes a power transistor 12 having a first conduction terminal coupled to a voltage input node (Vin) and a second conduction terminal coupled to a voltage output node (Vout). The power transistor 12 typically comprises an n-channel MOSFET device so that the first conduction terminal is the drain node and the second conduction terminal is the source node. A control terminal of the power transistor 12 (for example, the gate node of the n-channel MOSFET device) is driven by the output of a driver circuit 14 with a voltage (Vgate). The driver circuit 14 has a positive power supply terminal connected to a positive power supply node (Vsupply) and a negative power supply terminal connected to a ground power supply node (GND). In an implementation, the supply voltage and the input voltage may be same voltage. An input of the driver circuit 14 is coupled to the output of an error amplifier circuit 16 which generates an error signal Vc. The error amplifier circuit 16 may, for example, comprise an operational transconductance amplifier (OTA) having a non-inverting input coupled to receive a reference voltage (Vref) and an inverting input coupled to receive a feedback voltage (Vfb). The error amplifier circuit 16 has a positive power supply terminal connected to the positive power supply node (Vsupply) and a negative power supply terminal connected to the ground power supply node (GND). A feedback circuit network 18 is coupled between the output node Vout and the second input of the amplifier circuit 16 to provide the feedback voltage Vfb. The feedback circuit network 18 may, for example, comprise a resistive divider circuit formed by series connected resistors R1 and R2 connected between the output node Vout and the ground power supply node (GND). A tap node of the resistor divider circuit generated the feedback signal Vfb and is coupled to the inverting input of the error amplifier circuit 16. A compensation network 20 is coupled between the input of the driver circuit 14 and the ground supply node (GND) to compensate the stability of the feedback loop. The compensation network 20 may, for example, comprise the series connection of a resistor R3 and capacitor Cc.

The OTA for the error amplifier circuit 16 provides a first stage of the regulator functioning to amplify the error voltage difference between Vref and Vfb. The amplified error signal Vc is input to the driver circuit 14. The driver circuit 14 drives the control terminal of the power transistor 12 with the voltage Vgate in response to the error signal Vc. During normal operation of the linear regulator circuit 10, the total current delivered from the power supply (Vsupply and Vin) is given by currents I1+I2+I3 (where current I1 is the bias current of the error amplifier circuit 16, current I2 is the bias current of the driver circuit 14, and current I3 is the current flowing through the power transistor 12). The total current sunk to the ground (GND) is given by currents I1+I2+I5 (wherein current I5 is the current flowing through the feedback network 18 to ground). The current delivered to the load is current I4, wherein I3=I4+I5. The current I1 is a relatively small current consumed by operation of the OTA. The current I2, however, is relatively much larger than current I1 because the driver circuit 14 needs to drive the control terminal (gate capacitance) of the power transistor 12. The quiescent current of the linear regulator 10 is given by currents I1+I2+I5. When there is no requirement of the load, the current I4 is zero. The standby current of the linear regulator circuit is thus also given by the currents I1+I2+I5.

The linear regulator circuit 10 is a power supply system that is widely used in applications where good transient response and low noise is needed. One drawback of the linear regulator circuit 10 is power efficiency. There is significant power loss on the power transistor device. To minimize this waste, the driver circuit 14 must be strong so as to operate the power transistor with a low dropout between the input voltage Vin and the output voltage Vout. Furthermore, use of a strong driver circuit 14 supports operation of the linear regulator with a good loading capability (such as, for example, high output current, good transient response, good power supply rejection ratio (PSRR)). However, provision of a strong driver circuit comes at the expense of a large current consumption (more specifically from the bias current I2 required to operate the driver circuit 14).

Although an n-channel power MOSFET device is shown in FIG. 1, it will be understood that the linear regulator circuit 10 could instead use a p-channel power MOSFET device. The n-channel device is usually chosen when the output current needs are large because the n-channel device is more effective than a p-channel device in handling larger currents with a smaller device size. Additionally, the n-channel power MOSFET device will typically provide a better transient response. With the use of an n-channel power MOSFET device, however, a strong driver circuit 14 is required in order to achieve satisfactory transient response and operating stability. Operation of such a driver circuit 14 undesirably necessitates a large quiescent operating current. There would be an advantage if the linear regulator circuit architecture could instead support a highly reduced quiescent operating current. It would additionally be an advantage if the linear regulator circuit architecture provided a low power standby behavior when the load requirements are low.

Figure 2:
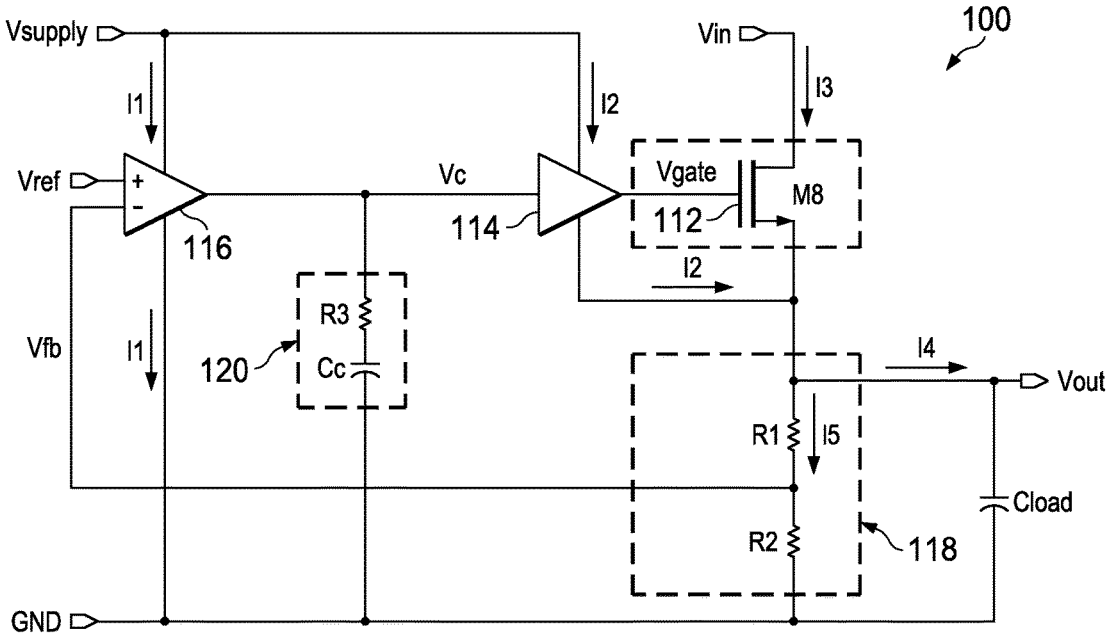
FIG. 2 is a circuit diagram for an embodiment of a linear regulator circuit with reduced quiescent current consumption.

Reference is now made to FIG. 2 showing an embodiment of a linear regulator circuit 100 with reduced quiescent current consumption. The circuit 100 includes a power transistor 112 having a first conduction terminal coupled to a voltage input node (Vin) and a second conduction terminal coupled to an output voltage node (Vout). The power transistor 112 typically comprises an n-channel MOSFET device so that the first conduction terminal is the drain node and the second conduction terminal is the source node. A control terminal of the power transistor 112 (for example, the gate node of the n-channel MOSFET device) is driven by the output (Vgate) of a driver circuit 114. The driver circuit 114 has a positive power supply terminal connected to a positive power supply node (Vsupply) and a negative power supply terminal connected to the output node Vout. In an implementation, the supply voltage and the input voltage may be same voltage. An input of the driver circuit 114 is coupled to the output of an error amplifier circuit 116 which generates an error signal Vc. The error amplifier circuit 116 may, for example, comprise an operational transconductance amplifier (OTA) having a non-inverting input coupled to receive a reference voltage (Vref) and an inverting input coupled to receive a feedback voltage (Vfb). The error amplifier circuit 116 has a positive power supply terminal connected to the positive power supply node (Vsupply) and a negative power supply terminal connected to a ground power supply node (GND). A feedback circuit network 118 is coupled between the output node Vout and the second input of the amplifier circuit 116. The feedback circuit network 118 may, for example, comprise a resistive divider circuit formed by series connected resistors R1 and R2 connected between the output node Vout and the ground power supply node (GND). A tap node of the resistor divider circuit generates the feedback signal Vfb and is coupled to the inverting input of the error amplifier circuit 116. A compensation network 120 is coupled between the input of the driver circuit 114 and the ground supply node (GND) to compensate the stability of the feedback loop. The compensation network 120 may, for example, comprise the series connection of a resistor R3 and capacitor Cc.

The OTA for the error amplifier circuit 116 provides a first stage of the regulator functioning to amplify the error voltage difference between Vref and Vfb. The amplified error signal Vc is input to the driver circuit 114. The driver circuit 114 drives the control terminal of the power transistor 112 with the voltage Vgate in response to the error signal. During normal operation of the linear regulator circuit 100, the total current delivered from the power supply (Vsupply and Vin) is given by currents I1+I2+I3 (where current I1 is the bias current of the error amplifier circuit 116, current I2 is the bias current of the driver circuit 114, and current I3 is the current flowing through the power transistor 112). The total current sunk to the ground (GND) in the circuit 100 of FIG. 2 is given by currents I1+I5 (wherein current I5 is the current flowing through the feedback network 18 to ground). In this circuit configuration, the bias current I2 for the drive circuit 114 is part of the load current such that I2+I3=I4+I5, wherein the current I4 is the current delivered to the load. The quiescent current for the linear regulator 100 is thus given by currents I1+I5. The current I1 is a relatively small current consumed by operation of the OTA. The current I2 is relatively much larger than current I1 because the drive circuit 114 needs to drive the control terminal of the power transistor 12. Assume that the current I4 required by the load decreases, and this will result in a corresponding decrease in the current I2. When there is no requirement of the load, i.e., the current I4 is zero, the standby current of the linear regulator circuit is also given by the currents I1+I5.

Figure 3:
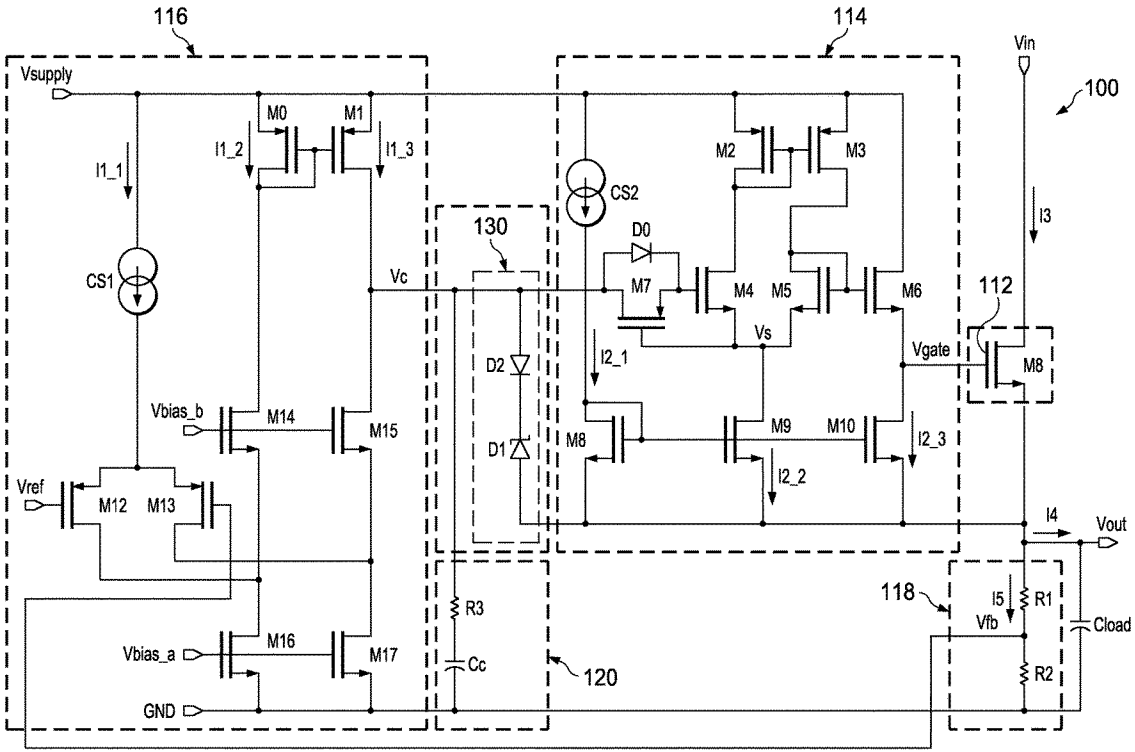
FIG. 3 is a transistor level circuit diagram of the linear regulator circuit of FIG. 2.

Reference is now made to FIG. 3 showing a transistor level implementation of the linear regulator circuit 100 based on the architecture shown in FIG. 2. Vsupply is the positive power supply voltage of the control circuitry for the regulator. Vin is the input voltage to be regulated by the regulator. Vsupply and Vin can be the same voltage, if desired.

The error amplifier circuit 116 is an OTA implemented using a one stage folded cascode amplifier design formed by transistors M0, M1, M12, M13, M14, M15, M16 and M17. The transistors M12 and M13 form the differential input transistor pair for the OTA. The current I1 is the tail current of the input differential transistor pair flowing through the tail current source CS1. The transistors M16 and M17 are configured as current source transistors biased by bias voltage Vbias_a. The transistors M14 and M15, biased by bias voltage Vbias_b, are cascode devices providing voltage bias for the drain terminals of transistors M12, M13, M16 and M17. The transistors M0 and M1 are load transistors forming a current mirror circuit. The output of the error amplifier circuit 116 is taken at the drain terminals of transistors M1 and M15 to provide the error signal Vc.

The compensation network 120 is formed by the series connection of capacitor Cc and resistor R3 between the output of the error amplifier circuit 116 and the ground power supply node (GND).

A clamp circuit 130 is formed by diodes D1 and D2 connected in series between the output of the error amplifier circuit 116 and the regulator output node Vout. The cathodes of the diodes D1 and D2 are connected together. The anode of diode D1 is connected to the output of the error amplifier circuit 116, and the anode of diode D2 (which is, for example, a zener diode) is connected to the regulator output node Vout. The clamp circuit 130 functions to clamp the voltage between Vc and Vout in order to protect the gate of power transistor 112, but it will be noted with this circuit that the voltage between Vout and Vc is not clamped. Those skilled in the art will recognize that the diodes D1 and D2 of the circuit 130 could be replaced by any kind of clamping circuit that matches the gate voltage rating of the power transistor 112.

The driver circuit 114 is formed by current source CS2, diode D0 and transistors M2, M3, M4, M5, M6, M7, M8, M9 and M10. Vc is the input of the driver circuit and Vgate is the output of the driver circuit. The diode D0 is the parasitic diode of transistor M7. When the voltage of error signal Vc is lower than the output voltage Vout, transistor M7 is off and the diode D0 and transistor M7 protect the gate of input transistor M4 from reverse breakdown. The transistors M2, M3, M4, M5 and M9 form a unity gain buffer circuit. The input of the buffer circuit is at the gate of transistor M4. The output of the buffer circuit is at the drain of transistor M5. The negative feedback is provided by connecting the drain and gate of transistor M5 together. The transistors M4 and M5 form a differential input transistor pair. Transistors M2 and M3 are the load transistors connected to form a current mirror circuit. Transistor M9 is the tail current source transistor for the input differential pair. Transistor M6 is connected as a source follower transistor whose bias current is provided by transistor M10. The current source CS2 is connected to the transistor M8 to form a bias generator circuit connected in a current mirror relationship with transistors M9 and M10 to provide the bias current for the driver output stage formed by transistors M6 and M10.

The feedback network 118 is formed by resistors R1 and R2 connected in series between the output node and the ground supply node. The tap node between resistors R1 and R2 generates the feedback voltage Vfb for application to the gate of transistor M13 in the error amplifier circuit 116. The reference voltage Vref is applied to the gate of transistor M12.

The linear regulator circuit 100 operates as follows:

The output voltage Vout is sensed by the feedback network 118 to generate the feedback voltage Vfb. The error voltage between Vref and Vfb is amplified by the error amplifier circuit 116 to generate the error signal Vc. The voltage Vgate output from the driver circuit 114 follows the voltage of the error signal Vc so as to control the gate voltage of power transistor 112. With the negative feedback loop, the feedback voltage Vfb will follow the reference voltage Vref and the output voltage at the output node Vout is regulated to:

$$Vout=Vref*(Vfb1+Vfb2)/Vfb2,$$

where Vfb1 and Vfb2 are the voltages across resistors R1 and R2, respectively.

The voltages of the error signal Vc, the output of the driver circuit 114 (Vgate) and the node Vs at the common connection of input transistors M4 and M5 in the driver circuit 114 will be controlled by the feedback loop for different load current. The current I2_1 is a fixed component of the driver circuit current I2 that is not controlled by the feedback loop. The currents I2_2 and I2_3 are variable components of the driver circuit current I2 that are controlled by the feedback loop. The current I3 is also a variable current controlled by the feedback loop. This control is exercised by controlling the voltages Vs and Vgate.

When the load current I4 is large, then: I4=I2_1+I2_2+I2_3+I3−I5.

The voltage Vgate at the output of the driver circuit 114 is controlled to meet this equation. As the load current I4 decreases, however, the voltage Vgate and the current I3 both decrease with the decrease in current I4 until the gate-to-source voltage (Vgs) of power transistor 112 is lower than its threshold and the current I3 is zero. Then: I4=I2_1+I2_2+I2_3−I5.

As the current I4 still further decreases, the feedback loop will decrease the voltages Vs and Vgate. The currents I2_2 and I2_3 will also decrease because the drain-to-source voltages of transistors M9 and M10 reduce.

When I4 is decreased to 0, then: I4=I2_1+I2_2+I2_3−I5=0 and I2_1+I2_2+I2_3=I5.

The minimum values of the currents I2_2 and I2_3 are zero when the drain-to-source voltages of transistors M10 and M11 are zero. However, as noted above, the current I2_1 has a fixed value that is not controlled by the feedback loop. Therefore, there exists a constraint in that I2_1<=I5. If I2_1>I5, then the current I4 cannot be zero.

It is important then to note that the driver circuit 114 in the linear amplifier circuit 100 is a floating driver whose negative supply terminal is directly connected to Vout. So, the bias current I2 of the driver circuit 114 is also part of the output current. This is different from the linear regulator circuit 10 of FIG. 1 where the bias current I2 instead flows to the ground supply node. The voltage of the error signal Vc, at the output of the error amplifier circuit 116 and the input of the driver circuit 114, thus not only controls the gate voltage of the power transistor 112, but also controls the bias current of the driver circuit in the range between the current I2_1 and the current I2_1+I2_2+I2_3 to provide a minimum current of I2_1. Thus, the quiescent current of the linear regulator circuit 100 is defined by the bias current of the error amplifier circuit 116 and the current of feedback network.

The circuit embodiment disclosed for the linear regulator 100 operates with an improved power efficiency in comparison to the circuit of FIG. 1. No matter how much output current is needed, operation of the circuit provides for a lower current consumption while maintaining loading capability. The quiescent current for the circuit is reduced to a level which is lower than the quiescent current of a normal two stage operational amplifier with the same bandwidth.

The foregoing description has been provided by way of exemplary and non-limiting examples of a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A linear regulator control circuit configured to control a power transistor coupled between an input voltage node and an output voltage node, the linear regulator control circuit comprising:

a feedback network having an input coupled to the output voltage node and an output configured to generate a feedback voltage;

an error amplifier having a first input configured to receive a reference voltage and a second input configured to receive the feedback voltage; and a driver circuit having an input coupled to an output of the error amplifier and an output coupled to drive a control terminal of the power transistor, the driver circuit having a first power supply terminal coupled to a first power supply node and a second power supply terminal coupled to the output voltage node, wherein a bias current of the driver circuit at the second power supply terminal is applied to the output voltage node.

2. The linear regulator control circuit of claim 1, wherein the feedback network is coupled between the output voltage node and a second power supply node.

3. The linear regulator control circuit of claim 1, wherein the error amplifier has a first power supply terminal coupled to the first power supply node and a second power supply terminal coupled to a second power supply node.

4. The linear regulator control circuit of claim 3, wherein the first power supply node is a positive supply node and the second power supply node is a ground supply node.

5. The linear regulator control circuit of claim 1, wherein the driver circuit comprises:

a buffer amplifier circuit having a differential input pair of transistors connected to a tail current source at a common node;

wherein the differential input pair of transistors are coupled to the first power supply terminal; and wherein the tail current source is coupled to the second power supply terminal.

6. The linear regulator control circuit of claim 1, wherein the driver circuit comprises:

a source follower transistor; and a bias current transistor;

wherein the source follower transistor and bias current transistor are coupled in series between the first power supply terminal and the second power supply terminal.

7. The linear regulator control circuit of claim 1, wherein the driver circuit operates in response to a bias current sourced from the first power supply node to the first power supply terminal, said bias current output from the driver circuit at the second power supply terminal and applied to the output voltage node.

8. A linear regulator control circuit configured to control a power transistor coupled between an input voltage node and an output voltage node, the linear regulator control circuit comprising:

a feedback network having an input coupled to the output voltage node and an output configured to generate a feedback voltage;

an error amplifier having a first input configured to receive a reference voltage and a second input configured to receive the feedback voltage; and a driver circuit having an input coupled to an output of the error amplifier and an output coupled to drive a control terminal of the power transistor, the driver circuit including an amplifier circuit coupled between a first power supply terminal and a second power supply terminal;

wherein said second power supply terminal of the driver circuit is directly connected to the output voltage node, and wherein a bias current of the driver circuit at the second power supply terminal is directly applied to the output voltage node.

9. The linear regulator control circuit of claim 8, wherein the amplifier circuit comprises:

a differential input pair of transistors connected to a tail current source at a common node;

wherein the differential input pair of transistors are coupled to the first power supply terminal; and wherein the tail current source is coupled to second power supply terminal.

10. The linear regulator control circuit of claim 8, wherein the driver circuit comprises:

a source follower transistor controlled by an output of said amplifier circuit; and a bias current transistor;

wherein the source follower transistor and bias current transistor are coupled in series between the first power supply terminal and the second power supply terminal.

11. The linear regulator control circuit of claim 8, wherein the driver circuit operates in response to a bias current sourced to the first power supply terminal, said bias current output from the driver circuit at the second power supply terminal and applied to the output voltage node.

12. A linear regulator control circuit configured to control a power transistor coupled between an input voltage node and an output voltage node, the linear regulator control circuit comprising:

a feedback network coupled between the output voltage node and a ground power supply node, and having an output configured to generate a feedback voltage;

an error amplifier having a first input configured to receive a reference voltage and a second input configured to receive the feedback voltage, said error amplifier having a first power supply terminal directly connected to a positive power supply node and a second power supply terminal directly connected to the ground power supply node; and a driver circuit having an input coupled to an output of the error amplifier and an output coupled to drive a control terminal of the power transistor, the driver circuit having a first power supply terminal directly connected to the positive power supply node and a second power supply terminal directly connected to the output voltage node.

13. The linear regulator control circuit of claim 12, wherein the driver circuit comprises:

a differential input pair of transistors connected to a tail current source at a common node;

wherein the differential input pair of transistors are coupled to the positive power supply terminal; and wherein the tail current source is directly connected to the output voltage node.

14. The linear regulator control circuit of claim 12, wherein the driver circuit comprises:

a source follower transistor; and a bias current transistor;

wherein the source follower transistor and bias current transistor are coupled in series, and the source follower transistor is directly connected to the positive power supply node and the bias current transistor is directly connected to the output voltage node.

15. The linear regulator control circuit of claim 12, wherein a bias current of the driver circuit at the second power supply terminal is applied to the output voltage node.

* * * * *